US006107735A

United States Patent [19]

Hora

[11] Patent Number: 6,107,735

[45] Date of Patent: Aug. 22, 2000

[54] ELECTROLUMINESCENT LAMP

[75] Inventor: Takayuki Hora, Shiga, Japan

[73] Assignee: NEC Corporation, Tokyo, Japan

[21] Appl. No.: 09/271,709

[22] Filed: Mar. 18, 1999

[30] Foreign Application Priority Data

Mar. 20, 1998 [JP] Japan ..... 10-071826

[51] Int. Cl.[7] ..... H05B 33/02

[52] U.S. Cl. ..... 313/506; 313/509

[58] Field of Search ..... 313/503, 506, 313/509, 511

[56] References Cited

U.S. PATENT DOCUMENTS 5,266,865 11/1993 Haizumi et al. ..... 313/506

*Primary Examiner*—Kenneth J. Ramsey
*Attorney, Agent, or Firm*—Hutchins, Wheeler & Dittmar

[57] ABSTRACT

In an electroluminescent lamp in which a transparent electrode, a light-emitting film, a reflective insulation layer, a reverse side electrode, and an outside insulation film are laminated onto the inside surface of a transparent film, a reduced-pressure process such as sputtering, electron beam deposition, or CVD is used to form a transparent auxiliary electrode thin film on the outside (light-emitting surface side) of the transparent film, this transparent auxiliary electrode thin film being grounded.

13 Claims, 5 Drawing Sheets

ELECTROLUMINESCENT LAMP

BACKGROUND OF THE INVENTION

1. Field of the Invention

The present invention relates to an electroluminescent lamp, and more particularly to an electroluminescent lamp having features such as noise prevention and electromagnetic shield, and which is suitable for use in backlighting of a liquid-crystal display.

2. Description of the Related Art

In recent years, with the rapid increase in use of such electronic equipment as cellular phones, PHS (Personal Handyphone System microcellular phones), radio pagers, digital watches, and portable personal computers, there has been an increase in the demand for thin surface illumination type electroluminescent lamps for use in backlighting of liquid-crystal displays.

When an electroluminescent lamp is caused to emit light by the application thereto of a high AC voltage, noise is generated, either from the electroluminescent lamp itself, or by an electrostatic coupling between the electroluminescent lamp and the liquid-crystal display.

Additionally, noise that is generated from inverters or other circuitry used to drive the electroluminescent lamp passes through the electroluminescent lamp and has an adverse affect on the liquid crystal display or electronic equipment.

For this reason, three-electrode electroluminescent lamps that with reduced noise and electromagnetic shielding have been developed. Such an electroluminescent lamp 30 is shown in an expanded cross-sectional view in FIG. 4, this having been described in the Japanese Unexamined Utility Model Publication (KOKAI) No. 3-37795.

As shown in FIG. 4, on the reverse, non-light-emitting side of an electroluminescent lamp 40 a third electrode sheet 50 is attached in intimate contact, using an adhesive.

The usual construction of the electroluminescent lamp 40 has such a configuration in that the lamp 40 includes an electroluminescent element 45, comprising a lamination of a reverse-side electrode 41 of aluminum foil or the like, a reflective insulation layer 42 made of barium titanate powder dispersed in a resin binder, a light-emitting layer 43 of a zinc sulfide phosphor dispersed in a resin binder, a transparent electrode 44 made of ITO or the like formed onto a transparent film, and the electroluminescent element 45, is sealed from the top and bottom thereof by external moisture prevention sealing films 48 and 49, with remaining lead electrodes 46 and 47 in extended condition from the transparent electrode 44 and the reverse-side electrode 41, respectively.

The third electrode sheet 50 is formed by sealing and insulating a metal foil 51 of aluminum or the like from the top and bottom by resin films 52 and 53, and making connection to the end thereof by a lead 54.

By electrically connecting the lead 54 of the third electrode sheet 50 to the lead electrode 46 of the transparent electrode 44 of the electroluminescent lamp 40, the transparent electrode 44 that is positioned at both sides of the reverse-side electrode 41 and the third electrode 51 are placed at the same potential, thereby preventing noise when AC drive is done.

If grounding is done, it is possible to achieve electromagnetic shielding.

Therefore, if this three-electrode electroluminescent lamp 30 is used as a backlight for a liquid crystal, because the high AC voltage that is applied to the EL element is shielded, not only is electromagnetic noise reduced, but also the electrostatic coupling with respect to the liquid crystal is blocked, this reducing the mutual interaction therebetween, so as to reduce noise.

In recent years, with rapid advancements in making more compact and lightweight electronic equipment having liquid-crystal displays, there has been an increase in the demand for thin electroluminescent lamps with reduced noise and electromagnetic shielding for use in backlighting for liquid-crystal displays.

However, with a electroluminescent lamp 30 having a three-electrode construction as in the past, because the third electrode sheet 50 construction is that of a metal foil 51 of aluminum or the like sealed by the resin sheets 52 and 53 from the top and bottom, to prevent pressure and the like applied during the sealing process from causing cracking and deformation of the metal foil 51, it is not possible to make the thickness of the metal foil 51 thin, this being required to be at least 35 $\mu$m.

For this reason, the overall thickness of the third electrode sheet as it is sandwiched between the resin sheets 52 and 53 was approximately 0.1 mm.

Additionally, the existence of the external moisture prevention sealing films 48 and 49 that seal the electroluminescent element 45 also hindered the achievement of a thin electroluminescent lamp, and when this is included the thickness of the electroluminescent lamp 40 became approximately 0.8 mm.

Therefore, the overall thickness of an electroluminescent lamp 30, formed by the overlaying of the electroluminescent lamp 40 and the third electrode sheet 50, was approximately 0.9 mm, this being extremely thick.

Accordingly, it is an object of the present invention to provide an electroluminescent lamp with noise prevention and electromagnetic shielding that is suitable for use as a backlight for a liquid-crystal display in, for example, portable electronic equipment.

SUMMARY OF THE INVENTION

In order to achieve the above-noted object, the present invention adopts the following basic technical constitution.

That is an electroluminescent lamp of the present invention is formed by a lamination onto an inside surface of a transparent film of minimally a transparent electrode, a light-emitting layer, a reflective insulation layer, and a reverse side electrode, the electroluminescent lamp comprising a transparent auxiliary electrode thin film that is formed on an outer surface of the transparent film and is connected to either one of the ground and the reverse side electrode.

More precisely, the present invention is an electroluminescent lamp that minimally has, laminated on the inside of a transparent film a transparent electrode, a light-emitting layer, a reflective insulation layer, and a reverse-side electrode, and on the outside of the above-noted transparent film has a transparent auxiliary electrode thin film that is formed by a thin-film forming means under reduced pressure, by sputtering, electron beam deposition, or CVD or the like, this transparent auxiliary electrode thin film being grounded.

In an electroluminescent lamp that makes use of the above-noted means, it is possible to form a third electrode from an extremely thin transparent auxiliary electrode thin film, and the transparent film that is the base film of the electroluminescent lamp can serve also as an insulating film for the third electrode.

Additionally, such an electroluminescent lamp with noise prevention and electromagnetic shielding, because it does not use an outer covering film, can be made significantly thinner than electroluminescent lamps in the past.

In addition, in an electroluminescent lamp which has minimally provided on the inside of a transparent film a lamination of a transparent electrode, a light-emitting layer, a reflective insulation layer, and a reverse-side electrode, by a thin-film forming means performed under a reduced-pressured condition such as sputtering, electron beam deposition, or CVD or the like, a transparent auxiliary electrode thin film is formed as a laminate on the outside surface of the transparent, this transparent auxiliary electrode thin film being grounded.

By virtue of the above-noted means, it is possible to form a third electrode from an extremely thin transparent auxiliary electrode film, and is possible to use the transparent film without using an external covering film, and thus such an electroluminescent lamp with noise prevention and electromagnetic shielding, as well as with thinner thickness than electroluminescent lamps in the past, can be obtained.

In particular, because a separate transparent conductive film having a transparent auxiliary electrode thin film is provided on the front of the electroluminescent lamp, the transparent film also serves as a protective layer for the transparent auxiliary electrode thin film, thereby eliminating the need to form a protective thin film, separately, this being less expensive than using a transparent conductive films with transparent electrodes that are formed on both sides of the transparent film.

Another feature of the present invention is that a protective thin film is formed over part of the transparent auxiliary electrode thin film, and a conductive lead electrode connections are taken from the transparent auxiliary electrode thin film via a conductive land that is formed on part of the above-noted protective film.

By virtue of this means, in addition to the above-noted effect, it is possible to protect the transparent auxiliary electrode thin film and to realize easily to make the lead electrode connection taken from the transparent auxiliary electrode thin film, with less cost.

Further, another technical feature of the present invention is such that the transparent auxiliary electrode thin film is formed with a certain pattern.

By virtue of this means, in addition to the above-noted effect, it is possible to have light from the electroluminescent lamp pass without attenuation through the region in which the transparent auxiliary electrode thin film is not formed, thereby alleviating a reduction in the average intensity of the electroluminescent lamp.

DESCRIPTION OF THE PREFERRED EMBODIMENTS

Preferred embodiments of the present invention are described in detail below, with references being made to the relevant accompanying drawings.

A feature of an electroluminescent lamp according to the present invention is that the front surface (light-emitting surface side) of the electroluminescent lamp is provided with a third electrode for the purpose of providing shielding, this being formed by a transparent auxiliary electrode thin film.

This transparent auxiliary electrode thin film is formed by an extremely thin film of tin oxide or indium oxide or the like, which is formed onto an insulating transparent film. The thickness is preferably in the range of approximately from 300 to 500 Angstroms.

The method of forming this film is a reduced-pressure thin-film forming means such as sputtering, electron beam deposition, CVD, or ALE.

Compared, for example, to printing or the like, this method has the advantage of enabling the formation of a significantly thinner film.

Because the transparent auxiliary electrode thin film is disposed on the light-emitting surface side, the visible light transmissivity, particularly in the emission spectrum of the electroluminescent lamp, should be high.

The lower is the surface resistance value of the transparent auxiliary electrode thin film, the greater will be the effects of noise prevention and shielding.

However, because with a lower resistance there is a lowering of the transmissivity, as a trade-off between these two characteristics, it is preferable that the resistance be in the range of 300 to 500 $\Omega/cm^2$.

The first embodiment of an electroluminescent lamp according to the present invention will be described with reference to FIG. 1.

Figure 1:
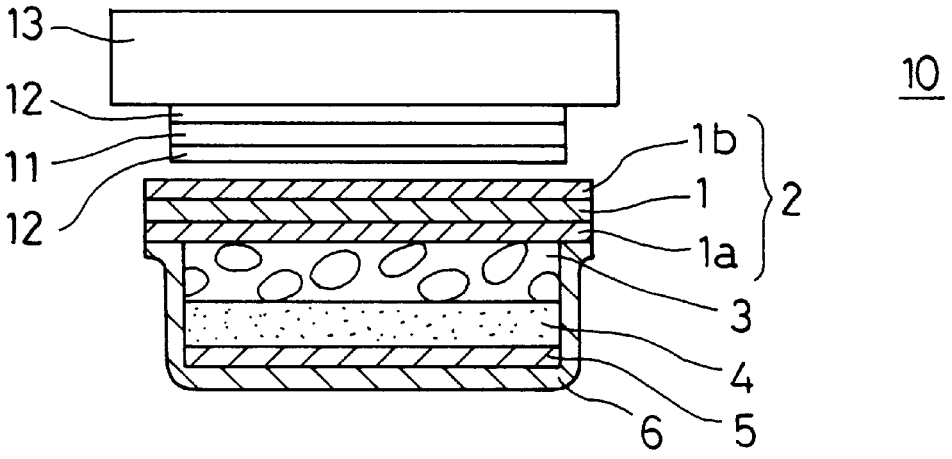
FIG. 1 is an enlarged cross-sectional view of the main part of an electroluminescent lamp having a three-electrode construction according to the first embodiment of the present invention.

The main part of the electroluminescent lamp 10 of the first embodiment that is shown in cross-sectional view in FIG. 1.

A feature of this electroluminescent lamp is that on the other (outer) side of a transparent film 1 onto the inner side of which is disposed a transparent electrode 1*a* is formed a thin film of a transparent auxiliary electrode 1*b*, which forms the third electrode, for the purpose of shielding.

The method of fabrication is that of first forming on one side (inner surface) of an insulating transparent film of PET or the like, having a thickness of 100 to 200 μm a transparent electrode 1*a*, using a reduced-pressure forming method such as sputtering, electron beam deposition, CVD or other method to form the transparent electrode 1*a* to a thickness of 300 to 500 Angstroms.

Next, on the other surface (outer surface) of this transparent film 1, by the same means a transparent electrode of ITO or the like is formed to a thickness of 300 to 500 Angstroms, this being used as the transparent auxiliary electrode 1*b*.

The transparent electrode 1*a* and the transparent auxiliary electrode 1*b* can be formed in separate chambers, and can also be formed within one and the same chamber.

Next, a pattern that excludes the electrical supply part (not shown in the drawing) on the transparent electrode 1 *a* is used to form a phosphor layer 3 of a thickness 35 to 45 μm , this being formed by dispersing a phosphor of zinc sulfide activated with copper into a resin, over which is formed a reflective insulating layer 4 of a white high dielectric such as barium titanate dispersed in a resin, this having a thickness of 10 to 15 μm.

Over this is formed a reverse side electrode 5, made of a conductive paste of silver or carbon, to a thickness of 10 to 20 μm, and a pattern over this electrode, excluding the electrical supply part (not shown in the drawing) is used to form an external insulating layer 6 to a thickness of 10 to 20 μm, screen printing being done in the above-noted sequence so as to obtain the electroluminescent lamp 10 having a three-electrode construction.

Figure 4:
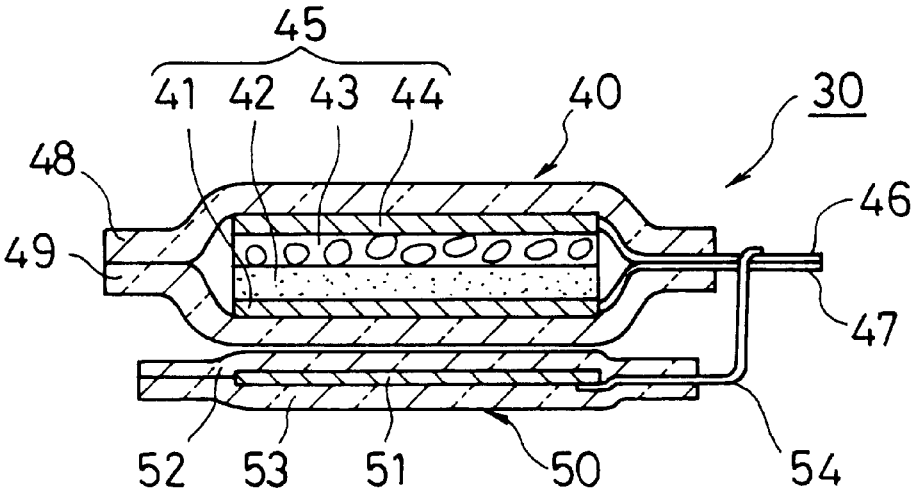
FIG. 4 is an enlarged cross-section view of the main part of an electroluminescent lamp having a three-electrode construction according to the prior art.

Because the thickness of the transparent auxiliary electrode 1*b* is no more than 500 Angstroms and the transparent film 1 serves also as the base material for the transparent auxiliary electrode 1*b*, the effective thickness of the third electrode is no more than 500 Angstroms, this being significantly thinner than the thickness (100 μm ) of the third electrode of the past that is shown in FIG. 4.

Additionally, because the outer covering films 48 and 49 as used in the past are not used, the overall thickness of the electroluminescent lamp 10 having a three-electrode construction is no more than 0.3 mm, this being less than ⅓ the thickness of the three-electrode electroluminescent lamp 30 of the past.

Because the transparent auxiliary electrode thin film 1*b* of the three-electrode electroluminescent lamp 10 is exposed, there is a danger of it becoming damaged during processing.

To prevent this from happening, a protective thin film (not shown in the drawing) can be formed on the transparent auxiliary electrode thin film.

While it is possible use a variety of material and forming methods for the protective film, it is necessary to be able to easily made a lead electrode connection from the transparent auxiliary electrode thin film 1*b*.

In consideration of this requirement, a thin film of an insulating metal oxide, such as silicon oxide or aluminum oxide is formed thinly (for example, to a thickness of approximately 0.11 μm).

By forming this film thinly and porously, when forming a conductive land of a conductive paste of silver or carbon on this insulating metal oxide thin film, because the conductive paste seeps from the space between the insulating metal oxide thin film and reaches the transparent auxiliary electrode thin film 1*b*, so as to make connection thereto, by further connecting a lead electrode to the land using an electrically conductive adhesive, it is possible to make electrical connection between the transparent auxiliary electrode thin film 1*b* and the connected lead electrode.

The above-noted configurations not only facilitate protection and lead electrode connection, but are also inexpensive.

Next, after fixing the three-electrode electroluminescent lamp 10 to a liquid crystal or liquid crystal holder 13 via butyl rubber 11 and the double-sided adhesive tapes 12, an AC power supply is supplied to the transparent electrode 1*a* and to the electrical supply parts of the reverse side electrode 5, via contact pins or the like, so as to cause emission of light.

When this is done, the lead electrode (not shown in the drawing) taken out from the transparent auxiliary electrode 1*b* is grounded.

By doing this, because the high AC voltage that is applied to the transparent electrode 1*a* is shielded by the transparent auxiliary electrode thin film 1*b*, the electrostatic coupling between the transparent electrode 1*a* and the liquid crystal or liquid crystal holder 13 is blocked, thereby reducing the mutual interaction therebetween and reducing noise.

By grounding the transparent auxiliary electrode thin film 1*b*, noise is blocked.

Even if the transparent auxiliary electrode thin film 1*b* is not grounded, noise can be reduced by making a connection of the transparent auxiliary electrode thin film 1*b* to the reverse side electrode 5.

Additionally, the transparent electrode 1*a* of the EL element can also be formed by printing a paste that is formed by dispersing a transparent conductive powder in a resin, in which case, although the thickness increases somewhat, the forming cost is reduced.

Hereunder, the protective film which is used in the present invention will be explained.

Figure 5:
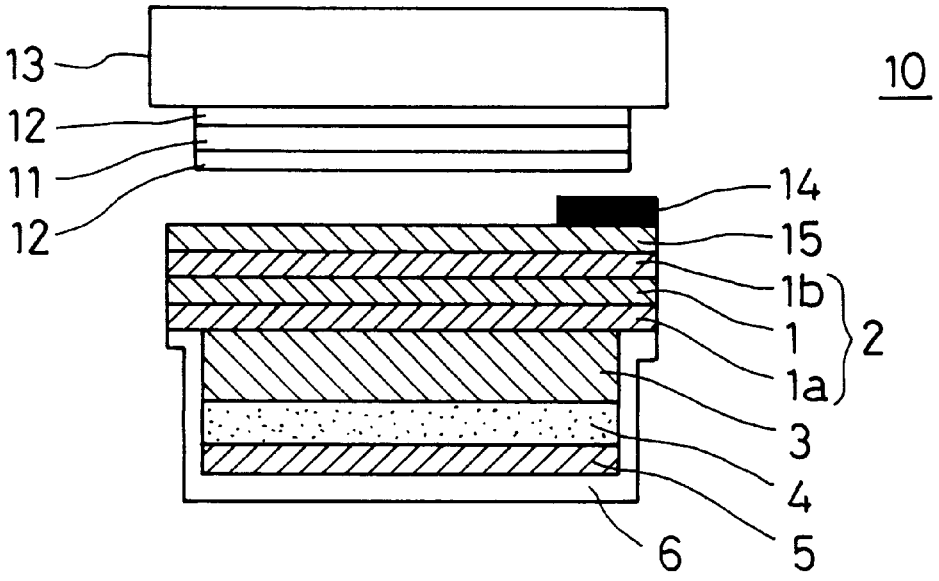
FIG. 5 is another enlarged cross-sectional view of the main part of an electroluminescent lamp having a three-electrode construction according to the first embodiment of the present invention.

The protective film 15 is formed on an entire surface of the transparent auxiliary electrode thin film 1*b* utilizing a transparent film having a superior anti-scratch characteristic such as organic materials coating, silicon oxide or the like, as shown in FIG. 5.

On the other hand, the conductive land 14 serves as a base material from which a lead electrode is extended as shown in FIG. 5, and it is formed by electrically conductive paste such as silver or carbon, and having a thickness of about from 10 to 15 μm.

The thickness of the protective film is preferably about 0.1 μm, taking electrical connecting characteristic caused by so called tunned effect and anti-scratch characteristic, into the account.

Note that when the thickness thereof is thicker than that value as mentioned above, the electrical connection will be deteriorated, while when it is thinner than that value, the anti-scratch characteristic will be deteriorated.

On the other hand, the thickness of the conductive land 14 is preferably set at around 10 to 15 μm, since when such a lead electrode, especially a lead electrode made of gold foil is attached, if the base material is formed only with the protective film 15, the protective film 15 does not bear with pressure caused when the a lead electrode is attached thereto and thus the transparent auxiliary electrode thin film is also scratched so as to loose shield effect.

Note that, when no protective film is provided and the transparent auxiliary electrode 1*b* is only exposed, and when the transparent auxiliary electrode 1*b* is rubbed by a cylindrical rod having a diameter of 15 mm and a bottom surface of which being provided with a wiper, with a load of 500 gf, the anti-scratch characteristic of the protective film 15 shows that the transparent auxiliary electrode thin film 1*b* had been pealed when it was rubbed 2 or 3 times with abrasion movement and the conductivity of that portion had been lost.

On the other hand, when the protective film 15 is provided, the conductivity thereof had not been changed even when more than 10 times of the abrasion movement had been applied to the transparent auxiliary electrode 1*b* under the same test as mentioned above, and thus the reliability of the transparent auxiliary electrode 1*b* with respect to a contact to a surface of the transparent auxiliary electrode 1*b*, during handling operation such as in production line, packaging, transporting operation and assembling or mounting operation.

Regarding the transparent auxiliary electrode as used in the present invention, as mentioned above, it is formed by a reduced-pressure thin film forming method.

Additionally, as a conventional method, it is known that such transparent auxiliary electrode is formed by a printing method such as a screen printing method or the liked, utilizing transparent conductive paste including ITO (indium oxide) filler.

However, in this prior art, since the transparent electrode made of such transparent conductive paste usually has a film thickness of around from 5 to 10 $\mu$m and thus being 100 to 200 times thicker than that of the transparent electrode, light transmissivity of the transparent electrode is low, and luminance is lowered by 10 to 20% comparing with a case in which a thin film electrode is used.

Further, since the transparent electrode made of the transparent conductive paste has green-brown color tone, and thus, an emitted light color is shifted relatively green color side comparing with a case in which a thin film electrode is used.

In recent year, there is a tendency in that blue color is preferred in the market and thus the specification of the transparent electrode made of such transparent conductive paste cannot respond to such market needs.

In another conventional shield type electroluminescent lamp includes an EL device comprising a lamination of a light emitting layer and a plurality of film material layers, for example, 4 or 5 layers of moisture absorbing films being stacked with heat lamination method and thereafter, it is laminated with external cover films.

Accordingly, the total thickness thereof will become more than 1 mm which is more that three times of that of the present invention having the thickness of about 0.3 mm.

In addition to this, when the transparent film is additionally provided with a shield film on a surface of which a transparent auxiliary electrode is deposited, the thickness thereof is further thickened by 0.1~0.2 mm.

Therefore, in the present invention, since the transparent film used for the electroluminescent lamp and the film which serves as a substrate used for the transparent auxiliary electrode are commonly formed so that a number of the films is only one, the increment of the thickness in the transparent film caused by adding such transparent auxiliary electrode is only corresponds to the thickness of th transparent auxiliary electrode, and accordingly, the maximum height of the transparent film is established up to around 300~500 Angstrom.

Figure 2:
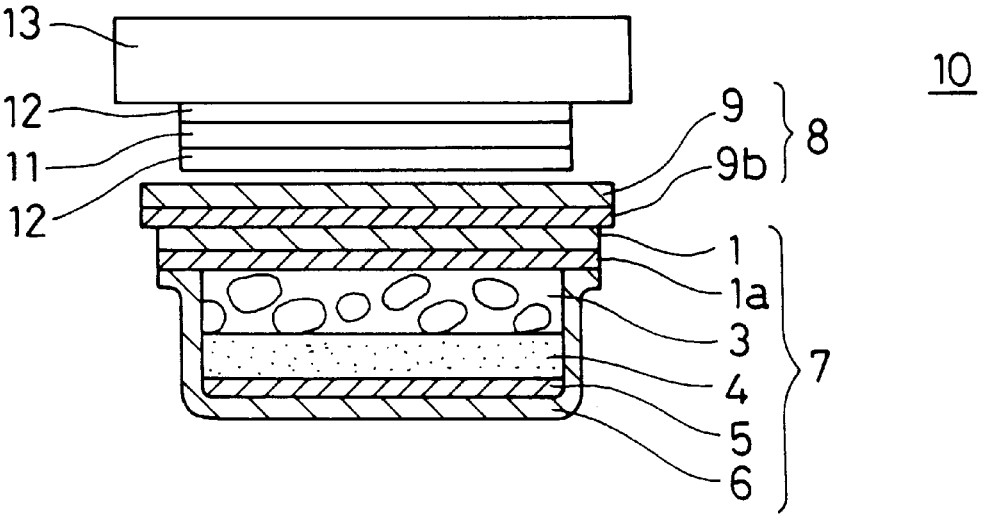
FIG. 2 is an enlarged cross-sectional view of the main part of an electroluminescent lamp having a three-electrode construction according to the second embodiment of the present invention.

Next, a second embodiment of an electroluminescent lamp according to the present invention will be described, with reference being made to FIG. 2.

The main part of the electroluminescent lamp 20 of the second embodiment of the present invention is shown in the form of an enlarged cross-sectional view.

A feature of this second embodiment is that, on the outer surface of the transparent film 1 of the outside (light-emitting side) of the electroluminesce nt element 7, a transparent conductive film 8 (formed as a film on a transparent auxiliary electrode 9*b*, which is a third electrode for the purpose of shielding one side of the transparent film 9) is attached by means of, for example, an adhesive or adhesive tape.

To prevent damage to the transparent auxiliary electrode 9*b* when this is done, it is desirable that the transparent auxiliary electrode 9*b* be disposed so as to make contact with the transparent film 1 of the electroluminescent element 7, in which case it is desirable that the lead electrode of the transparent auxiliary electrode 9*b* be taken out beforehand.

The method of fabricating the transparent auxiliary electrode 9*b* is that of forming on one side of a transparent insulating film 9 of PET or the like, which has a thickness of 500 to 750 $\mu$m, a transparent electrode of ITO or the like, using a reduced-pressure method such as sputtering, electron beam deposition, or CVD process or the like, this being formed to a thickness in the range from 300 to 500 Angstroms.

The method of fabricating the electroluminescent element 7, similar to that of the first embodiment, is that of forming by lamination, over a transparent electrode 1*a* formed on transparent film 1, a light-emitting layer 3, a reflective insulation layer 4, a reverse side electrode 5, and an outer insulation layer 6.

Although the thickness of the three-electrode electroluminescent lamp 20 according to the second embodiment is thicker than the electroluminescent lamp 10 according to the first embodiment, by the amount of the thickness of the transparent film 1, it is still thinner than electroluminescent lamps of the past.

It also offers a cost advantage because of the ability to use an inexpensive commercially available transparent conductive film.

Furthermore, the transparent electrode 1*a* of the EL element can be formed by printing of a paste that is made by dispersing a transparent conductive powder into a resin.

Next, variations of the transparent auxiliary electrode thin film will be described.

Figure 3:
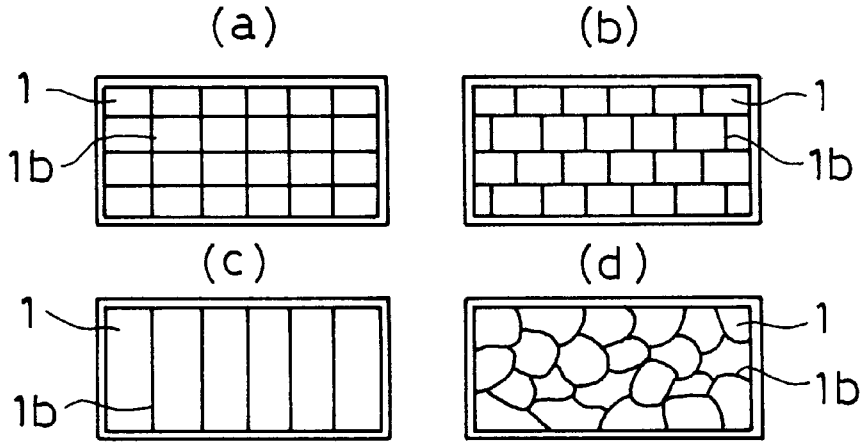
FIG. 3 is an enlarged plan view of the main part of an example of deformation of the shape of the transparent auxiliary electrode thin film in the present invention.

Although in the above-described first and second embodiments, the description was that of the example in which a process such as sputtering or deposition is used to form a uniform transparent auxiliary electrode thin film over almost the entire surface of the transparent film, variations of this are possible, in which, as shown in FIG. 3, the pattern that is used to form the transparent auxiliary electrode thin film 1*b* is one which locally exposes the transparent film 1 in a matrix, tiled (staggered), striped, or irregular manner.

Because in the region in which the transparent auxiliary electrode thin film is not formed light from the electroluminescent lamp can pass without attenuation, a reduction of the average intensity of the electroluminescent lamp is alleviated.

The patterning of the transparent auxiliary electrode thin film can be formed by overlaying a mask having openings in a prescribed pattern over the transparent film, and performing sputtering or the like therethrough.

It is also possible to etch a uniformly formed transparent auxiliary electrode film to obtain a pattern.

The pattern shape and size must, of course, be selected so as to prevent noise and achieve a shielding effect.

Next, the third embodiment of the present invention will be explained hereunder with referring to FIGS. 6 to 8.

An electroluminescent lamp according to the third embodiment of the present invention has a configuration in that a lead of transparent electrode, a lead of the reverse side electrode, and a lead of the transparent auxiliary electrode are provided on the same side of the transparent film.

In this embodiment, all of these electrodes are preferably provided on the reverse side of the electroluminescent lamp and more specifically on a reverse side of the transparent film corresponding to the side thereof at which the light-emitting layer 4 is located.

As mentioned above, in the conventional electroluminescent lamp with three electrodes, as shown in FIG. 4, a total thickness of the electroluminesce nt lamp 30 becomes about 1 mm and thus this size of the total thickness thereof causes a problem in making electric devices with liquid crystal display means having minimized size and minimized weight thereof which are rapidly developed, in recent years.

Accordingly, in these days, it is desired that a thin electroluminescent lamp with noise prevention and electromagnetic shielding that is suitable for use as a backlight for a liquid-crystal display, is realized.

Figure 9:
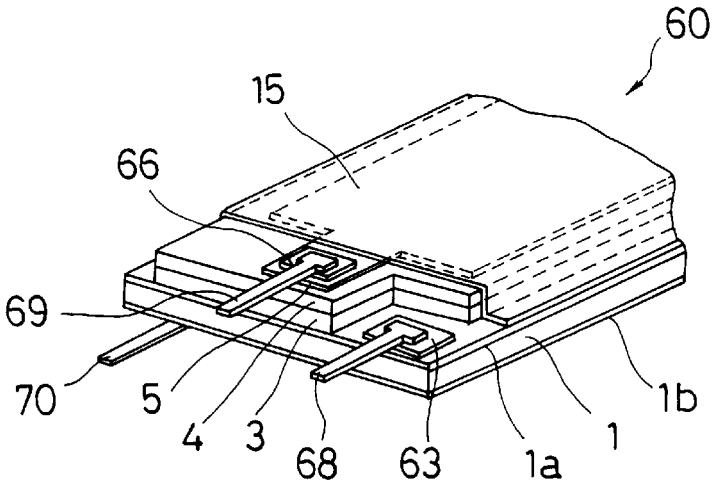
FIG. 9 is a schematic view of a different configuration of an electroluminescent lamp having a three-electrode construction being previously proposed but not a prior art.

Therefore, to attain this requirement for this kind of electroluminescent lamp, the inventor of this application has once proposed to make such electroluminescent lamp 60 as shown in FIG. 9.

In that, a transparent electrode 61*a* is provided on one of surfaces (inner side) of the transparent film 61 and an transparent auxiliary electrode 61*b*, which is used for shielding, is provided on the another side of the surface (outer side) of the transparent film 61.

Note that when this third electrode is grounded or connected to the reverse side electrode, the noise prevention and the electromagnetic shielding can be performed.

A method for making this electroluminescent lamp 60 is substantially the same method as explained above, in the first embodiment of the present invention.

However, regarding the lead electrode connecting construction to the electroluminescent lamp 60 having three electrodes of this embodiment, a power supplied contact portion 62 is provided with a lead 68 for transparent electrode made of a metallic foil, via conductive adhesive and a power supplied contact portion 66 is provided with a lead 69 for a reverse electrode made of a metallic foil, and further, these connecting portions of two lead electrodes 68 and 69, are fixedly connected to the transparent electrode and the reverse side electrode 65, respectively, with a heat seal tape or the like (not shown in FIG. 9) which covers each of the electrodes externally.

Further, a third lead electrode 70 made of metallic foil is connected to the transparent auxiliary electrode 61*b*, serving as the third electrode, with conductive adhesive and via an electric charge collecting means (not shown in FIG. 9) and this connecting portion is solidly fixed with a heat seal tape provided thereto externally, as a reinforcement.

However, in the lead electrode connecting construction of the thin type electroluminescent lamp 60 having three electrodes, as mentioned above, the lead 70 used as the third electrode is connected to an outer surface of the electroluminescent lamp 60, the outer surface thereof being opposite to the liquid crystal display means 13 as shown in FIG. 1, while the rest of two leads 68 and 69 used for the EL device, are connected to an inner surface of the electroluminescent lamp 60, which is the opposite surface to which the third lead electrode 70 is connected.

Accordingly, in the process for making this electroluminescent lamp 60 as mentioned above, a step of connecting the lead 68 for transparent electrode and the lead 69 for the reverse electrode must be connected to the power supplied contact portion 62 and 66, formed on the back surface side (inner side) of the electroluminescent lamp 60, respectively, is necessary and further a step of reversing the surfaces of the electroluminescent lamp to the respective surfaces of which, both of the lead electrodes are contacted, respectively, and a step for connecting the third lead electrode 70 to the transparent auxiliary electrode 61*b*, are also necessary.

Therefore, in this process, there exist problems in that the number of process is increased and the apparatus for making same becomes complicated so that the production cost is increased, since the connecting operation of the leads 68 and 69 used for the EL device and the connecting operation of the third lead electrode 70 must be done in separate steps to each other.

In the third embodiment of the present invention can provide such thin type electroluminescent lamp with lower cost.

Figure 6:
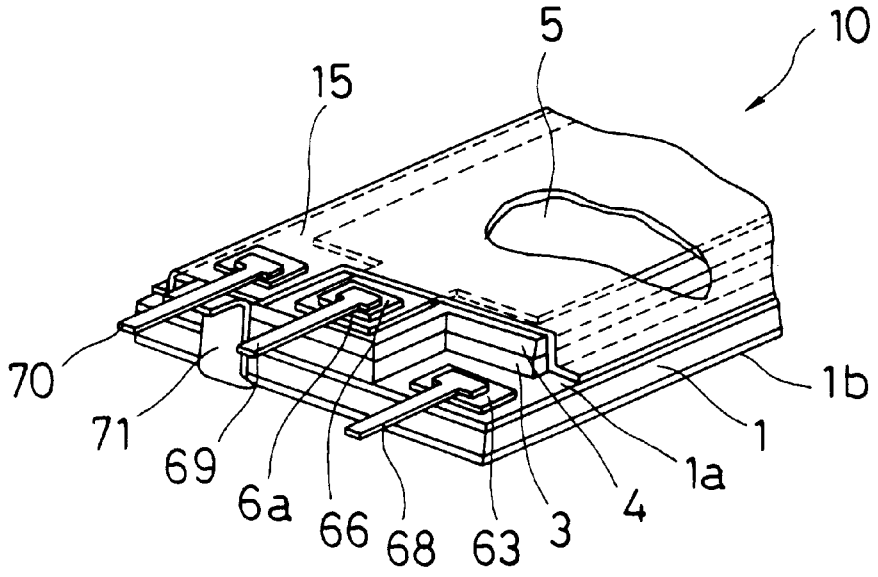
FIG. 6 is a schematic view of an electroluminescent lamp having a three-electrode construction according to the third embodiment of the present invention.

As shown in FIG. 6, an electroluminescent lamp 10 of the third embodiment of the present invention comprises an EL device 7 in which a lamination of a transparent electrode 1*a*, a light-emitting layer 3, a reflective insulation layer 4 and a reverse side electrode 5 is formed on inner side (or back side) surface of the transparent film 1, and a transparent auxiliary electrode 1*b* is formed on outer side (or external side) surface of the transparent film 1 and wherein a lead for the transparent electrode 68, a lead for the reverse side electrode 69 and a lead for transparent auxiliary electrode 70 are formed on the back side surface (inner side surface) of the electroluminescent lamp 10.

In this embodiment, all of these electrodes 68, 69, and 70 are preferably provided on the reverse side of the electroluminescent lamp 10 and more specifically on a reverse side of the transparent film 1 corresponding to the side thereof at which the light-emitting layer 3 is located.

In this embodiment, the electroluminescent lamp 10 may have a transparent conductive film on which the transparent auxiliary electrode is provided, on outer side (or external side) surface of the transparent film 1, instead of using only the transparent auxiliary electrode.

In this embodiment, the lead for transparent auxiliary electrode 70 is fixedly connected to the protective layer 15 covering overall the EL device and also connected to the transparent auxiliary electrode 1*b* which is provided on the outer surface of the transparent film 1 via a conductive member 71.

Figure 7:
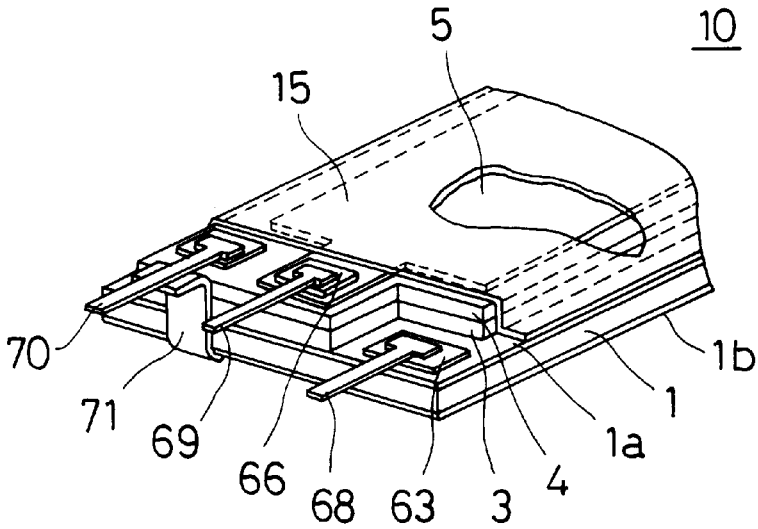
FIG. 7 is a schematic view of another configuration of an electroluminescent lamp having a three-electrode construction according to the third embodiment of the present invention.

A separate configuration of this embodiment is shown in FIG. 7.

In this embodiment, the lead for transparent auxiliary electrode 70 is fixedly connected to the reflective insulation layer 4 of the EL device and also connected to the transparent auxiliary electrode 1*b* which is provided on the outer surface of the transparent film 1 via a conductive member 71.

Figure 8:
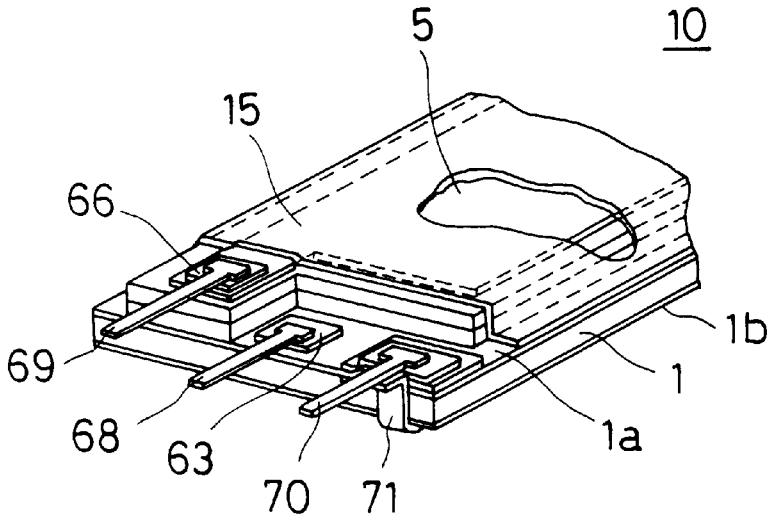
FIG. 8 is a schematic view of further separate configuration of an electroluminescent lamp having a three-electrode construction according to the third embodiment of the present invention.

A further separate configuration of this embodiment is shown in FIG. 8.

In this embodiment, the lead for transparent auxiliary electrode 70 is fixedly connected to the transparent electrode 1*a* of the EL device and also connected to the transparent auxiliary electrode 1*b* which is provided on the outer surface of the transparent film 1 via a conductive member 71.

As mentioned above, in the electroluminescent lamp as shown in FIG. 4 and FIG. 9, it was necessary to contact the lead electrodes to both sides of the EL device and in doing this, since the conventional lead electrode attachment device to the EL device, is configured that a part of the lead electrodes is connected to one of surfaces of the EL device in one step and thereafter the rest of the lead electrodes are connected to the opposite surface of the EL device in the separate step, it was very difficult to connect a plurality of lead electrodes to one surface of the EL device, in one step.

In the present invention, at least three lead electrodes are connected to a same surface of the EL device and additionally, the transparent auxiliary electrode serving as a lead electrode for electromagnetic shielding, is connected thereto under electrically insulated condition.

After that the transparent auxiliary electrode 1*b* serving as shielding member and formed on the surface of the transparent film 1 and which is opposite to the liquid crystal display means 13 and the lead for transparent auxiliary electrode 70, serving as a lead electrode for electromagnetic shielding are connected electrically with conductive member 71 such as an electrically conductive tape or the like so as to obtain the electromagnetic shielding effect.

By forming the electroluminescent lamp 10 with this manner as mentioned above, among a plurality of lead attaching steps, a step of connecting one lead to the surface of the EL device opposite to the liquid crystal display means, a step of attaching an insulating tape to this device and a step of reversing the surface of the EL device and setting the device for attaching again the lead to the device can be omitted.

On the other hand in the electroluminescent lamp as shown in FIG. 4 and FIG. 9, a base material of the transparent auxiliary electrode from which a lead is extended therefrom with some electric conductive material must be formed utilizing an conductive paste such as carbon or silver, so as to protect the transparent electrode when a metallic lead is connected thereto.

However, in the present invention, since the conductive material can be made of relatively soft material, a layer of such conductive paste is no more necessary in forming the base material of the transparent auxiliary electrode and thus the number of steps and the cost for materials can be reduced.

Note that in this invention, although a number of steps for connecting the transparent auxiliary electrode to the shielding lead electrode utilizing the conductive material such as a tape or the like, will be increased, total cost for obtaining connection by extending the lead electrode from the EL device can be reduce by half of that as mentioned above.

Figure 10:
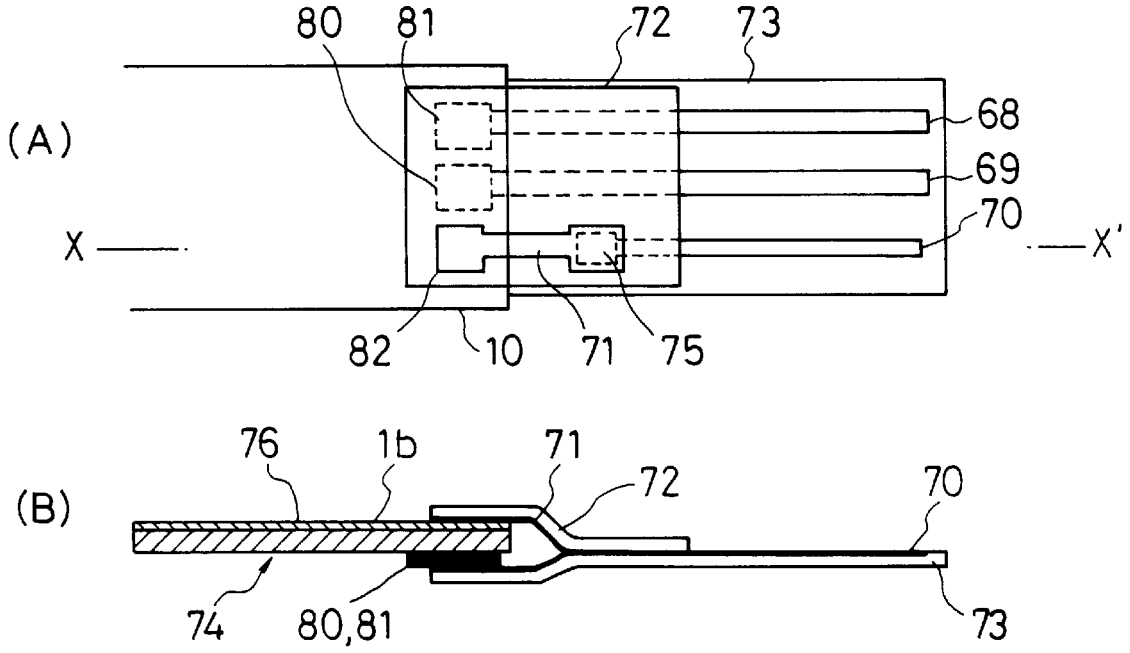
FIG. 10 is a further different enlarged cross-sectional view of the main part of an electroluminescent lamp having a three-electrode construction according to the third embodiment of the present invention.

FIG. 10 shows another embodiment of the present invention, and in that electroluminescent lamp, the lead electrodes are not formed by the metallic lead but are formed by flexible lead electrodes such as a flat cable or a heat seal connector.

In FIG. 10(A) shows the connecting portion of the present embodiment in that EL device 10 has two heat seal connectors 72 and 73, one heat seal connector 72 being connected to one surface 76 of the EL device 10, opposite to the liquid crystal display means 13, while another heat seal connector 73 connected to the reverse side surface 74 of the EL device 10.

Note that, FIG. 10 (B) is a cross-sectional configuration seen from the X-X' line of FIG. 10(A).

And the heat seal connector 73 is provided with three different conductive lines 68, 69 and 70 on one surface of the heat seal connector 73, each being formed in parallel to each other and the conductive lines 68 and 69 are connected to electrodes 80 and 81, for activating the EL device 10, respectively.

On the other hand, the heat seal connector 72 is provided with a conductive material 71, formed on one surface thereof and one end of which being connected to a shield electrode, i.e., the transparent auxiliary electrode 1*b* which is formed on the surface of the EL device 76 through a shield electrode 82, while the opposite end thereof being connected to the conductive line 70 formed on one surface of the heat seal connector 73, via a suitable shield electrode connection portion 75.

According to the present invention, by obtaining an electroluminescent lamp by forming a laminate of a transparent electrode, a light-emitting layer, a reflective insulation layer, a reverse side electrode, and an outer insulation layer onto one side of a transparent film, and then forming a laminated transparent auxiliary electrode thin film onto the light emitting side of this electroluminescent lamp by using a reduced-pressure process such as sputtering, electron beam deposition, or CVD, and then either grounding this transparent auxiliary electrode thin film or connecting it to the reverse side electrode, it is possible to obtain an electroluminescent lamp that has a third electrode formed by an extremely thin transparent auxiliary electrode thin film, the transparent film that serves as the base material for the electroluminescent lamp also serving as an insulating film for the third electrode.

This electroluminescent lamp can use as an inexpensive commercially available transparent conductive film as the third electrode and, because this electroluminescent lamp does not use an outer covering film, it is significantly thinner than electroluminescent lamps of the past, and provides not only noise prevention and electromagnetic shielding, but also low cost.

What is claimed is:

1. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film, wherein said light-emitting layer and said reflective insulation layer are formed by a lamination on said transparent electrode with a pattern excluding a lead connection part for a lead of said transparent electrode, and further wherein said reverse side electrode is formed on said reflective insulation layer with a pattern excluding a lead connection part for a lead of said transparent auxiliary electrode, and further wherein said transparent auxiliary electrode thin film is connected to either the ground or said reverse side electrode.

2. An electroluminescent lamp formed by a lamination onto an inside surface of a transparent film of minimally a transparent electrode, a light emitting layer, a reflective insulation layer, and a reverse side electrode, said electroluminescent lamp comprising a transparent conductive film that is formed on an outer surface of said transparent film, said transparent conductive film comprising a transparent auxiliary electrode thin film formed on a separate transparent film, said transparent auxiliary electrode thin film is connected to either the ground or said reverse side electrode.

3. An electroluminescent lamp according to claim 1, wherein both said transparent auxiliary electrode thin film and said transparent electrode are conductive thin films formed by a thin-film means under a reduced pressure.

4. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film, said transparent auxiliary electrode thin film is connected to either the ground or said reverse side electrode, said transparent auxiliary thin film is formed by a prescribed pattern.

5. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film, said transparent auxiliary electrode thin film is connected to either the ground or said reverse side electrode, said transparent auxiliary electrode thin film is further provided with a protective film that is formed onto a part of said transparent auxiliary electrode thin film, and a lead electrode that is led out from said transparent auxiliary electrode thin film via a conductive land that is formed onto part of said protective film.

6. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film, said transparent auxiliary electrode thin film is connected to either the ground or said reverse side electrode, a lead of said transparent electrode, a lead of said reverse side electrode, and a lead of said transparent auxiliary electrode are provided on the same side of said transparent film.

7. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film, said transparent auxiliary electrode thin film is connected to either the ground or said reverse side electrode, and a lead of said transparent auxiliary electrode are provided on the side of said transparent film at which said light-emitting layer is located.

8. An electroluminescent lamp formed by a lamination onto an inside surface of a transparent film of minimally a transparent electrode, a light-emitting layer, a reflective insulation layer, and a reverse side electrode, said electroluminescent lamp comprising a transparent auxiliary electrode thin film that is formed on an outer surface of said transparent film and is connected to either one of the ground and said reverse side electrode, and further wherein said transparent auxiliary electrode thin film is formed on an outer surface of said transparent film with a separate transparent film interposed therebetween.

9. An electroluminescent lamp according to claim 8, wherein said transparent auxiliary electrode thin film is a conductive thin film that is formed by a thin-film means under a reduced pressure.

10. An electroluminescent lamp according to claim 8, wherein said transparent auxiliary electrode thin film is formed by a prescribed pattern.

11. An electroluminescent lamp according to claim 8, wherein said transparent auxiliary electrode thin film is further provided with a protective film that is formed onto a part of said transparent auxiliary electrode film, and a lead electrode that is led out from said transparent auxiliary electrode thin film via a conductive land that is formed onto part of said protective film.

12. An electroluminescent lamp according to claim 8, wherein a lead of said transparent electrode, a lead of said reverse side electrode, and a lead of said transparent auxiliary electrode are provided on the same side of said transparent film.

13. An electroluminescent lamp according to claim 12, wherein said side of said transparent film corresponds to the side thereof at which said light-emitting layer is located.

* * * * *